United States Patent [19]

Ueda et al.

[11] Patent Number: 4,737,726

[45] Date of Patent: Apr. 12, 1988

[54] CHARGED PARTICLE BEAM STORAGE AND CIRCULATION APPARATUS

[75] Inventors: Koju Ueda; Manabu Mizota, both of Tokyo; Shiro Nakamura, Amagasaki; Shintaro Fukumoto, Kobe; Takebumi Narikawa, Tokyo, all of Japan

[73] Assignee: Mitsubishi Denki Kabushiki Kaisha, Tokyo, Japan

[21] Appl. No.: 887,769

[22] Filed: Jul. 21, 1986

[30] Foreign Application Priority Data

Jul. 19, 1985 [JP] Japan ..... 60-158086
Jul. 26, 1985 [JP] Japan ..... 60-163905

[51] Int. Cl.[4] ..... H05H 13/04; H05H 7/08
[52] U.S. Cl. ..... 328/233; 328/235
[58] Field of Search ..... 328/235, 233

[56] References Cited

U.S. PATENT DOCUMENTS 3,328,708 6/1967 Smith et al. ..... 328/235

OTHER PUBLICATIONS

"Sor-Ring-An Electron Storage Ring Dedicated to Spectroscopy", by T. Miyahara et al, *Particle Accelerators,* vol. 7, No. 3, pp. 163-175, 1976.

*Primary Examiner*—Palmer C. DeMeo
*Attorney, Agent, or Firm*—Sughrue, Mion, Zinn, Macpeak & Seas

[57] ABSTRACT

An apparatus for accelerating and circulating a beam of charged particles includes a circular equilibrium orbit 3 for circulating the particles, a plurality of inflectors 2*a*–2*g* disposed in a spiral path sequence where the charged particles are introduced into the orbit, and negative and positive electrode pairs 18*a,* 18*b* disposed flanking the orbit to draw off and neutralize positive ions generated from residual gas in the vacuum chamber of the apparatus.

7 Claims, 2 Drawing Sheets

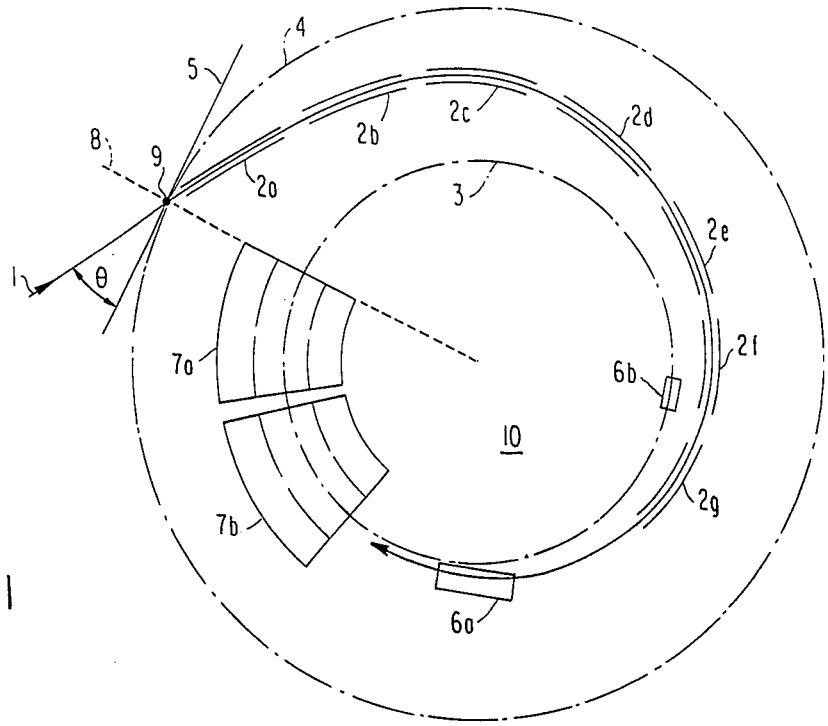
FIG. 1
FIG. 2
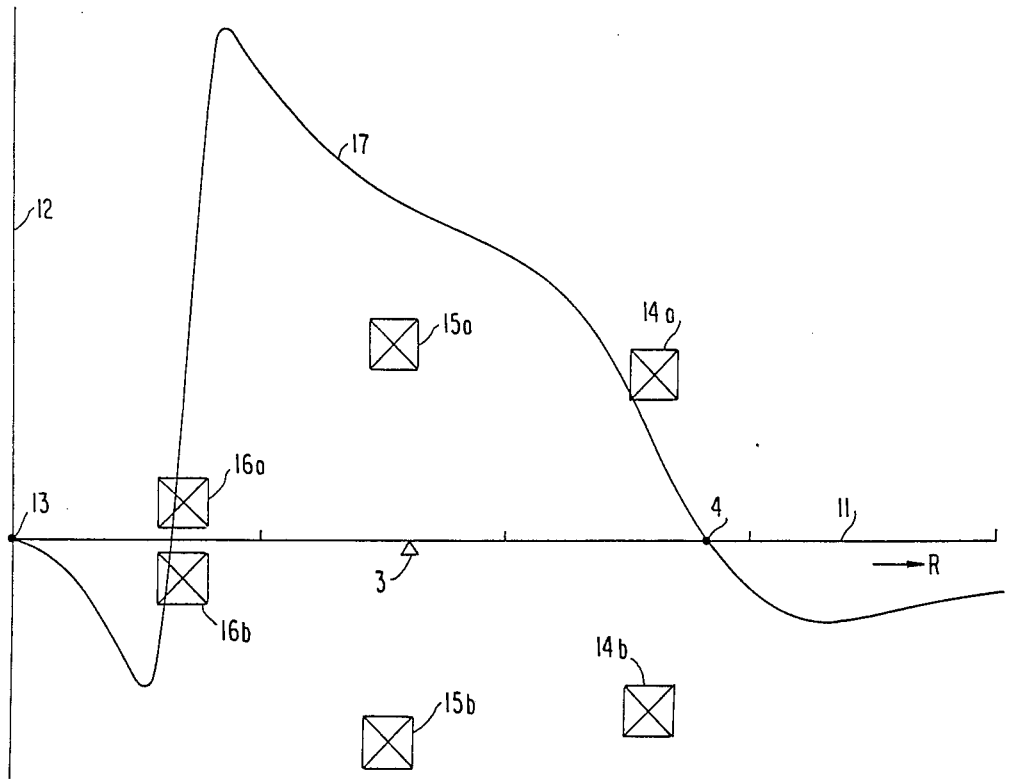

CHARGED PARTICLE BEAM STORAGE AND CIRCULATION APPARATUS

BACKGROUND OF THE INVENTION

This invention relates to a charged particle apparatus including synchrotrons and storage rings for accelerating charged particle beams such as electron beams.

The charged particle apparatus according to the present invention can be applied to both synchrotrons and storage rings. The following description will be given taking a storage ring into consideration, and electron beams are chosen as an example for the representative charged particle beams.

In a conventional storage ring plural pairs of quadrupole electromagnets for focusing electrons, plural bending electromagnets for deflecting the electrons, bump electromagnets for generating a fast-pulse magnetic field and radio frequency cavities for generating a radio frequency electric field are disposed along an equilibrium orbit which passes through inflectors located at the electron injection site. The storage ring thus constructed causes an electron beam of high energy to run along the equilibrium orbit and enables the high-energy electron beam to maintain its kinetic energy for several hours to several tens of hours.

One of the applications of the storage ring is a light source for manufacturing very large scale integrated circuits (VLSIs) in which synchrotron radiation is utilized. It is injected when the high-energy electron beam is running along the equilibrium orbit. Conventionally, a linear accelerator or a synchrotron of the known kind is provided on the upstream side of the storage ring.

The electron beam is fed from the accelerator through inflectors disposed in part of the straight sections of the storage ring. These straight sections are free from any magnetic fields or electric fields, and in which the inflectors, bump electromagnets and radio frequency cavities having the following functions are disposed. The electron beam of high energy circulating in the storage ring runs along the equilibrium orbit having a weak focusing magnetic field distribution.

The electron beam injected from the accelerator into the storage ring has a fixed angle with respect to the straight section of the orbit. The electron beam passing through the inflector having its center of curvature located directly opposite to that of the bending electromagnets runs parallel with the orbit and is then injected from the inflector into the storage ring. As is well known, the deflection of the electron beam is performed by an electric field produced between the negative and positive electrodes of the inflector, whose center of curvature is located opposite to that of the storage ring. Although the electron beam injected from the inflector runs parallel with the equilibrium orbit, its center has a certain amount of deviation from the center of the orbit; the sectional center of the electron beam thus oscillates around the equilibrium orbit and collides with a vacuum tank containing the electron beam to cause the partial loss of the beam.

The amplitude of the oscillation is equal to the deviation of the electron beam. Because of this the electron beam, after passing through the inflector, tends to have a reduced central amplitude and intersects with the orbit. If the angle between the electron beam and the orbit at this first intersection made after the injection can be made zero, the loss in the electron beam can be minimized.

The bump electromagnet is disposed at this intersection to achieve this purpose. The time requirement of its high speed pulse magnetic field is determined by the speed at which the magnetic field of the bump electromagnet becomes zero before the electron beam completes one whole circle after passing the intersection.

The electron beam fed into the equilibrium orbit loses its kinetic energy due to the braking action of the six bending electromagnets when synchrotron orbital radiation is emitted. The radio frequency cavities are provided to compensate for this kinetic energy loss. That is, the electron beam maintains its position on the orbit by obtaining kinetic energy from an accelerating electric field produced within the radio frequency cavities.

The path for the electron beam is contained within the vacuum tank, and the inflector as well as the bump electromagnet are also usually installed within the tank. In the conventional charged particle apparatus this construction requires straight sections for installing the inflectors, the quadrupole electromagnets, the radio frequency cavities and the like, which makes it difficult to provide a sufficiently compact apparatus.

SUMMARY OF THE INVENTION

In view of the foregoing, it is a main object of the present invention to provide an improved charged particle apparatus in which the use of straight sections in the conventional apparatus is omitted and thus the structure is made more compact. This object is accomplished by providing a charged particle apparatus comprising a circular equilibrium orbit having a weak focusing electromagnetic field for circulating charged particles and a plurality of inflectors disposed along the introducing area of the charged particles in such a way that their centers of curvature progress inwardly toward the center of the equilibrium orbit.

Another object of the present invention is to provide an improved charged particle apparatus capable of circulating an electron beam for a long period of time by removing positive ions produced through collisions between the electron beam and gas contained inside the equilibrium orbit envelope which is kept at a vacuum. This object is accomplished by providing plural pairs of alternating positive and negative electrodes disposed flanking the equilibrium orbit.

BRIEF DESCRIPTION OF THE DRAWINGS

FIG. 1 is a schematic plan view of a charged particle apparatus embodying features of the present invention;

FIG. 2 is a diagram illustrating the arrangement and magnetic field intensity distribution of air-core coils in the embodiment of FIG. 1;

DETAILED DESCRIPTION OF THE PREFERRED EMBODIMENTS

Figure 3:
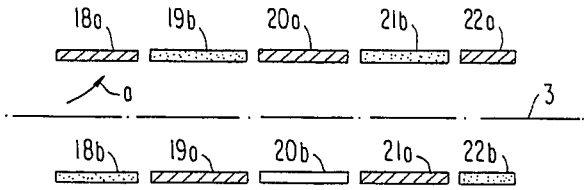
FIG. 3 is a schematic side view in section of another embodiment derived from the modification of the charged particle apparatus shown in FIG. 1.

Referring to FIG. 1, there is shown a storage ring 10 which is used as a light source for exposing work in the manufacture of very large scale integrated circuits (VLSIs), embodying the present invention. In the figure a train of inflectors starting from a first inflector 2*a* through a seventh inflector 2*g* are arranged in sequence in an approximate circular arc in the area of introduction of electron beam 1 so that a round equilibrium orbit 3 for the electron beam is formed.

In this arrangement the centers of curvature of the inflectors are located progressively inwardly toward the center of the equilibrium orbit 3. The introducing area is also provided with a rectangular bump electromagnet 6*a*, and first and second radio frequency cavities 7*a*, 7*b* are disposed along the equilibrium orbit 3 together with a fine adjustment bump electromagnet 6*b*. A point 9 on the magnetic field boundary 4 of the storage ring 10 touches a tangent line 5, with respect to which the electron beam 1 runs at a fixed angle $\theta$ and passes through point 9 in the direction of a radius vector 8. Synchrotron orbital radiation emitted from part of the circular equilibrium orbit 3 passes through the gap between the fourth and fifth inflectors 2*d*, 2*e*, for example, to be utilized as intended.

The electron beam 1 which is fed from an accelerator located upstream from the storage ring 10 is introduced at a fixed angle $\theta$, 30 degrees for example, with respect to the tangent line 5 and fed through the first to the seventh inflectors 2*a*–2*g*. It is further passed through the rectangular bump electromagnet 6*a* to render it parallel with the equilibrium orbit 3.

The sectional center of the electron beam 1 then tends to slowly oscillate around the center of the equilibrium orbit 3. This oscillation is eliminated by the bump electromagnet 6*b* which reduces any angular deviation between the electron beam 1 and the equilibrium orbit 3 to zero. This occurs at the point where the center of the electron beam 1 initially crosses the equilibrium orbit 3; at a point having a weak focusing electromagnetic field distribution.

The radiation loss of a synchrotron depends on the kinetic energy of the electron beam 1. Where it is about 800 MeV with the circular equilibrium orbit having a diameter of about 1.6 m, the loss will be approximately 45 KeV. To lengthen a quantum life sufficiently with such a high radiation loss it is necessary to produce a higher accelerating voltage in radio frequency cavities. This is sometimes difficult to achieve with a single radio frequency cavity. Taking this into consideration, the present embodiment utilizes the two such cavities 7*a* and 7*b*. Of course, there are cases in which a single cavity will perform the intended purposes.

FIG. 2 shows the magnetic field distribution 17 of the storage ring 10 thus constructed and an example of the coil arrangement to form such field distribution. The abscissa 11 starting from the origin 13 coincides with the radius vector 8 and indicates the lateral position of the equilibrium orbit 3. The ordinate 12 represents the relative positional dimensions of the coils and the relative magnetic field intensity 17. By determining the dimension of the equilibrium orbit 3, dimensions for large diameter upper and lower coils 14*a*, 14*b*, middle diameter upper and lower coils 15*a*, 15*b*, and small diameter upper and lower coils 16*a*, 16*b* for forming the required magnetic field can be obtained.

As schematically shown in FIG. 2 the magnetic field of the storage ring 10 is built up of air-core coils, which can be replaced with either superconducting coils or normal conducting coils according to the required magnetic field strength and the diameter of the orbit 3. A positive magnetic field is formed inside the magnetic field boundary 4 shown in FIG. 1. It provides a weak focusing magnetic field of the known kind near the equilibrium orbit to prevent the horizontal and vertical dissipation of the electron beam, which serves a function equivalent to the quadrupole electromagnets in the conventional apparatus. For the portion of the electron beam 1 outside the magnetic boundary 4 where the magnetic field becomes negative, the magnetic intensity is reduced to a negligible level by an appropriate magnetic shelter. The first through the seventh inflectors 2*a*–2*g* are, in contrast to conventional ones, disposed to form an approximate circular arc such that their centers of curvature are located progressively inwardly toward the center of the circular equilibrium orbit.

The inflectors 2*a* through 2*g* shown in FIG. 1 are located within the magnetic field encompassing the center of the storage ring. The electric field applied by these inflectors formed by applying voltage between negative and positive electrodes, however, is oriented in a direction to increase the radius of curvature of the electron beam 1 on comparing with in case of no existing of inflectors. In this way the inflectors according to the present invention have the same function as that of the conventional inflectors.

Because of these inflectors the beam 1 introduced at point 9 can be fed into the equilibrium orbit without an excessive bending by the magnetic field. The number of the inflectors will be selected depending upon the magnetic intensity of the storage ring 10 and the kinetic energy of the electron beam. Electron flux steadily circulating along the equilibrium orbit 3 will run for several hours to several tens of hours while emitting synchrotron orbital radiation (not shown) and with having lost energy consumed by the synchrotron radiation supplied through the first and second radio frequency cavities 7*a* and 7*b*. The electron beam thus circulating the orbit is under a vacuum of $10^{-9}$ to $10^{-11}$ torrs.

Figure 4:
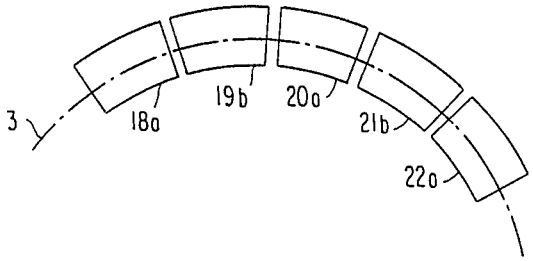
FIG. 4 is a schematic plan view of FIG. 3.

When the circulating current increases more than hundreds of milliamperes, positive ions in the vacuum are accumulated in the electron beam and collisions occurring between these ions and the electron beam can become a problem. This will limit the amount of the electron beam running along the equilibrium orbit 3 and thus the current flow in the storage ring 10, which may impose a restriction on increasing the circulating current when a high intensity light source using the synchrotron orbital radiation is required. That is, without providing means to eliminate positive ions produced by collisions between the electron beam circulating the orbit and residual gas in the vacuum, as accumulated current increases its volume, the circulating period of the current will be inevitably shortened because of the positive ions being trapped in the electron beam. FIGS. 3 and 4 show another embodiment in the concerned portion of the present invention which solves this problem. In these figures a first pair of negative and positive electrodes 18*a* and 18*b*, respectively, are disposed vertically flanking the equilibrium orbit 3 to remove the positive electrons from the beam running along the orbit. Likewise, second through fifth pairs of negative and positive electrodes 19*a* and 19*b* to 22*a* and 22*b* are disposed in sequence. The construction of this embodiment is identical to the embodiment shown in FIG. 1 other than the provision of the electrode pairs. The operation of the modified embodiment will now be explained with reference to the first pair of electrodes 18*a* and 18*b*.

Between the first negative electrode 18*a* and the first positive electrode 18*b* a voltage of several kV for example is applied to form an electric field between them. In this electric field positively charged particles will be accelerated toward the negative electrode 18*a* and negatively charged particles will be accelerated toward the positive electrode 18*b*. Since positive ions existing between the electrodes 18*a* and 18*b* in the electron flux have low kinetic energy, they are accelerated toward the first negative electrode 18*a* with their speed and direction depending on the distance between the electrodes 18*a* and 18*b* as well as their length. They then collide with the electrode 18*a* and are neutralized. The kinetic energy of each electron in the beam running between the electrodes 18*a* and 18*b* is very large compared with the energy the electrons obtain from the electric field formed by the electrodes 18*a* and 18*b*. Therefore, the pair of negative and positive electrodes 18*a* and 18*b* installed along the orbit 3 will not adversely affect the stable movement of the electron beam but will be effective in removing the positive ions. In the case when plural pairs of negative and positive electrodes are required as shown in the figures for removing a considerable amount of ions accumulated in tens of thousands of electron beam circulations along the equilibrium orbit, however, the cumulative effect of the plural pairs of electrodes cannot be ignored.

To minimize this effect adjacent pairs of negative and positive electrodes are disposed in reversed polarity to each other. For example, the second positive electrode 19*b* is disposed next to the first negative electrode 18*a* and the second negative electrode 19*a* is disposed next to the first positive electrode 18*b*; a stable electron beam circulation along the equilibrium orbit 3 is thus effected for a considerable number of cycles.

The negative and positive electrodes in the abovementioned embodiment may be composed of flat conductors, curved conductors, or plates in which insulated conductors are installed. When eddy currents induced on the electrodes by the interaction between the electron beam and the electrodes must be avoided, electrodes having a mesh structure can be used as shown schematically for a portion of electrode 20*a* in FIG. 4. Although the inflectors 2*a* through 2*g* for introducing the electron beam 1 gradually into the equilibrium orbit 3 using an electric field have been described for the aforesaid embodiments, a system using a magnetic field such as generated by the bump electromagnet 6*a* can also be utilized. Likewise the number of inflectors is not limited to seven, and an inflector using an electric field can be used in place of the bump electromagnet 6*a*.

The magnetic field for a storage ring formed by air-core coils as described can be replaced with iron-core electromagnets in the area near the equilibrium orbit 3 as is well known. Therefore, the present invention is not limited to a system using air-core coils. Furthermore, the storage ring can be equipped to implement both synchrotron and storage ring functions, in which case the intended purposes can be achieved with a lesser number of inflectors since the kinetic energy of an injected electron beam can be made much lower than the energy stored in the ring.

What is claimed is:

1. A charged particle apparatus for accelerating charged particles, comprising:

(a) means defining a continuously curved, circular equilibrium orbit (3) without any straight sections for circulating a charged particle beam within a weak focusing electromagnetic field, and (b) a plurality of inflectors (2*a*–2*g*) successively disposed along an introduction area of said charged particle beam and within said electromagnetic field, said inflectors having centers of curvature located progressively inwardly toward a center of said equilibrium orbit to thus define a spiral introduction path to render an incoming beam substantially parallel with said equilibrium orbit at a point of entry thereinto.

2. An apparatus as defined in claim 1, further comprising a pair of negative and positive electrodes (18*a*, 18*b*) disposed vertically flanking said equilibrium orbit for attracting and neutralizing positive ions accumulated in said beam.

3. An apparatus as defined in claim 2, wherein a plurality of said electrode pairs are disposed successively along and flanking said equilibrium orbit, adjacent pairs of electrodes being disposed in a reversed polarity manner.

4. An apparatus as defined in claim 1, further comprising a plurality of radio frequency cavities (7*a*, 7*b*) disposed along said equilibrium orbit.

5. An apparatus as defined in claim 4, further comprising a rectangular bump electromagnet (6*a*) disposed along said introduction path between said plurality of radio frequency cavities and an innermost one of said inflectors.

6. A apparatus as defined in claim 1, further comprising a fine adjustment bump electromagnet (6*b*) disposed along said equilibrium orbit to eliminate oscillations of said circulating beam.

7. An apparatus as defined in claim 2, wherein said electrodes have a mesh structure.

* * * * *